US007581567B2

(12) United States Patent
Ward et al.

(10) Patent No.: US 7,581,567 B2
(45) **Date of Patent: *Sep. 1, 2009**

(54) PAPERMAKER'S FORMING FABRIC WITH CROSS-DIRECTION YARN STITCHING AND RATIO OF TOP MACHINE DIRECTION YARNS TO BOTTOM MACHINE DIRECTION YARNS OF 2:3

(75) Inventors: Kevin John Ward, Nova Scotia (CA); Christine Barratte, Saint-Claude (FR)

(73) Assignee: Weavexx Corporation, Wake Forest, NC (US)

( * ) Notice: Subject to any disclaimer, the term of this patent is extended or adjusted under 35 U.S.C. 154(b) by 265 days.

This patent is subject to a terminal disclaimer.

(21) Appl. No.: 11/380,675

(22) Filed: Apr. 28, 2006

(65) Prior Publication Data

US 2007/0251594 A1 Nov. 1, 2007

(51) Int. Cl.
*D03D 3/04* (2006.01)
*D21F 1/10* (2006.01)

(52) U.S. Cl. ..... 139/383 A; 162/348; 162/903

(58) Field of Classification Search ..... 162/117, 162/348, 358.2, 900, 902–904; 139/383 A, 139/425 A, 383 AA
See application file for complete search history.

(56) References Cited

U.S. PATENT DOCUMENTS 5,013,330 A * 5/1991 Durkin et al. ..... 51/297
7,001,489 B2 * 2/2006 Taipale et al. ..... 162/348
7,487,805 B2 * 2/2009 Barratte et al. ..... 139/383 A
2007/0199609 A1 * 8/2007 Ward ..... 139/383 A

FOREIGN PATENT DOCUMENTS

DE 3318960 A1 11/1984

* cited by examiner

*Primary Examiner*—Eric Hug
(74) *Attorney, Agent, or Firm*—Myers, Bigel, Sibley & Sajovec, P.A.

(57) ABSTRACT

A triple layer papermaker's fabric includes: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns. The top MD yarns and the top CMD yarns are interwoven in a series of repeat units and the bottom MD yarns and the bottom CMD yarns are interwoven in a series of corresponding repeat units. The set of top MD yarns comprises a first number of top MD yarns in each repeat unit, and the set of bottom MD yarns comprises a second number of bottom MD yarns in each repeat unit, and the ratio between the first number and the second number is 2:3. In this configuration, a fabric may have enhanced properties, including higher top surface open area, higher permeability, and improved fabric stability.

19 Claims, 3 Drawing Sheets

PAPERMAKER'S FORMING FABRIC WITH CROSS-DIRECTION YARN STITCHING AND RATIO OF TOP MACHINE DIRECTION YARNS TO BOTTOM MACHINE DIRECTION YARNS OF 2:3

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,745,797 to Troughton.

U.S. Pat. No. 5,967,195 to Ward discloses a triple layer fabric in which pairs of stitching yarns extend in the cross machine direction and form part of the papermaking surface, in essence "completing the weave" of the papermaking surface, while also stitching with the bottom layer. The fabrics disclosed in Ward have the same number of top machine direction yarns and bottom machine direction yarns. Such fabrics have proven to provide an excellent papermaking surface and to combat inter-layer wear. Although these fabrics have performed successfully in many applications, there is a trend toward finer yarns on the paper side of the fabric. However, because the tensile resistance of a yarn is proportional to the square of its diameter, as finer yarns are employed, the paper side layer of the fabric can become weaker. As such, fabric development continued to search for fabrics with sufficient drainage, particularly on the paper side, that still provide adequate fiber support for the production of many types of paper.

U.S. Patent Publication No. 2005/0268981 to Barratte discloses a fabric with CMD stitching yarn pairs flat has twice as many bottom CMD yarns as top CMD yarns. In some embodiments, these fabrics have proven to improve fiber support and drainage. However, for some applications, higher top surface open area, higher permeability and improved fabric stability may be desirable.

SUMMARY OF THE INVENTION

As a first aspect, embodiments of the present invention are directed to a triple layer papermaker's fabric comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns. The top MD yarns and the top CMD yarns are interwoven in a series of repeat units and the bottom MD yarns and the bottom CMD yarns are interwoven in a series of corresponding repeat units. The set of top MD yarns comprises a first number of top MD yarns in each repeat unit, and the set of bottom MD yarns comprises a second number of bottom MD yarns in each repeat unit, and the ratio between the first number and the second number is 2:3. In this configuration, a fabric may have enhanced properties, including improved surface topography higher permeability and fabric stability.

As a second aspect, embodiments of the present invention are directed to a triple layer papermaker's fabric comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of stitching yarn pairs that interweave with the top MD yarns, wherein each of the stitching yarns interweaves with the bottom MD yarns. The top MD yarns and the top CMD yarns are interwoven in a series of repeat units and the bottom MD yarns and the bottom CMD yarns are interwoven in a series of corresponding repeat units. A stitching yarn pair is positioned between each adjacent pair of top CMD yarns. The set of top MD yarns comprises a first number of top MD yarns in each repeat unit, and the set of bottom MD yarns comprises a second number of bottom MD yarns in each repeat unit, and the ratio between the first number and the second number is 2:3.

As a third aspect, embodiments of the present invention are directed to a method of making paper, comprising the steps of (a) providing a fabric of the structure described above, (b) applying paper stock to the fabric, and (c) removing moisture from the paper stock.

DETAILED DESCRIPTION OF EMBODIMENTS OF THE INVENTION

Figure 1:
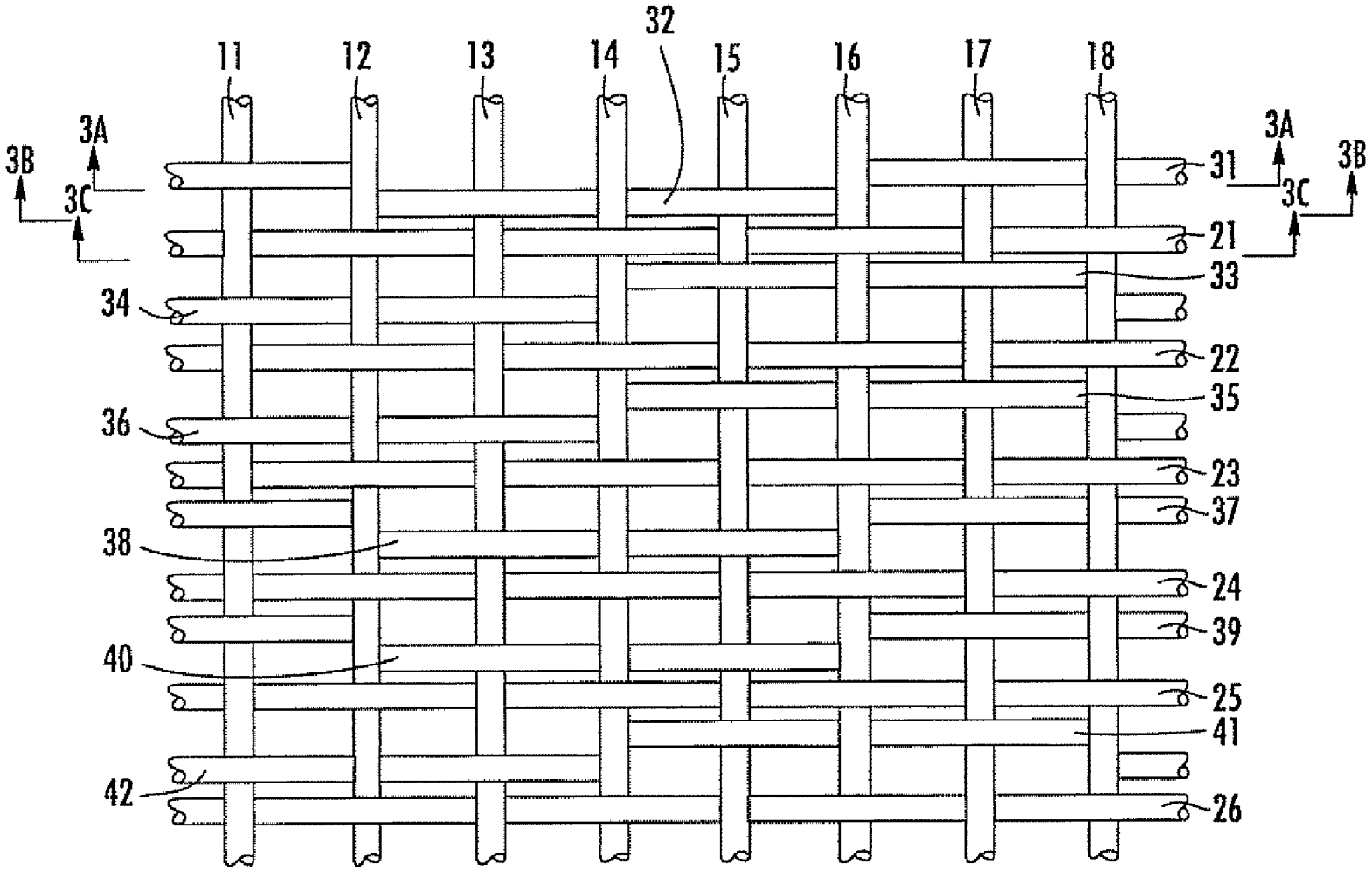
FIG. 1 is a top view of the top layer of a repeat unit of a fabric according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Although the figures below only show single repeat units of the fabrics illustrated therein, those of skill in the art will appreciate that in commercial applications the repeat units shown in the figures would be repeated many times, in both the machine and cross machine directions, to form a large fabric suitable for use on a papermaking machine.

Figure 2:
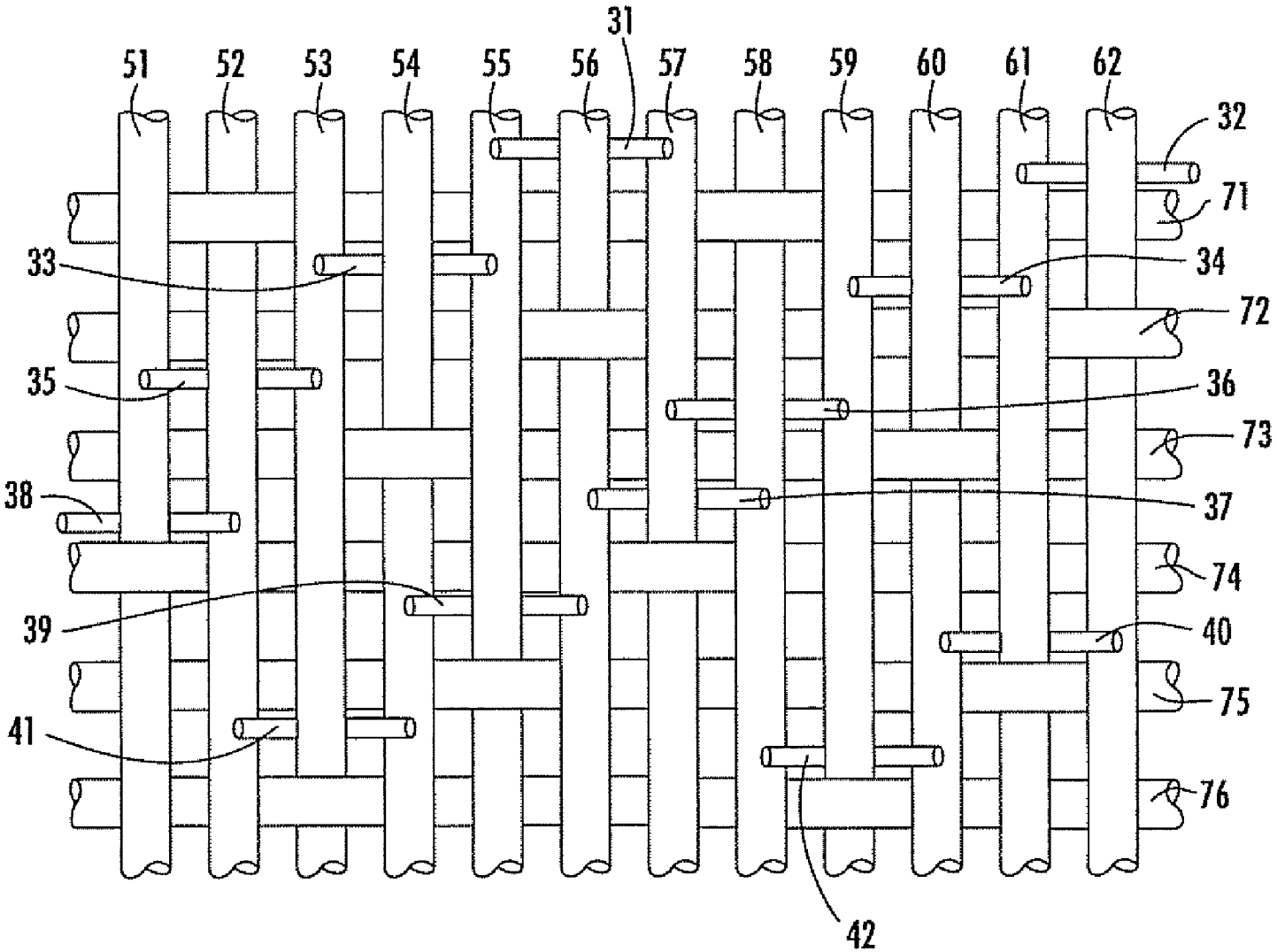
FIG. 2 is a top view of the bottom layer of the fabric of FIG. 1.

Referring now to the figures, a twenty harness triple layer forming fabric, generally designated at 10, is illustrated in FIGS. 1 and 2, in which a single repeat unit of the fabric is shown. The fabric 10 includes eight top MD yarns 11-18, six top CMD yarns 21-26, twelve bottom MD yarns 51-62, six bottom CMD yarns 71-76, and six pairs of stitching yarns 31-42. The interweaving of these yarns is described in detail below.

Figure 3A:
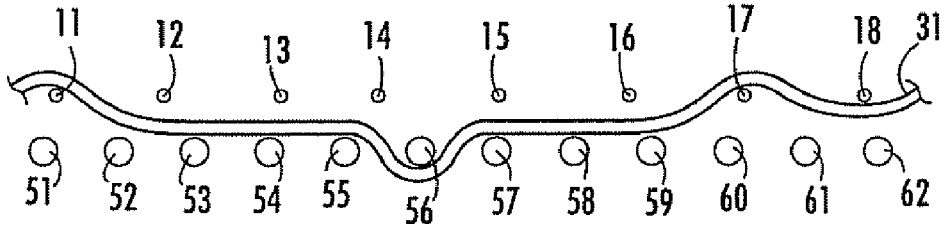
FIGS. 3A-3C are section views taken along lines 3A-3A, 3B-3B, and 3C-3C, respectively, of the fabric of FIG. 1.
Figure 3B:
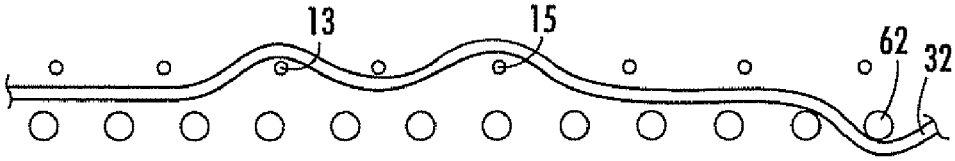
Figure 3C:
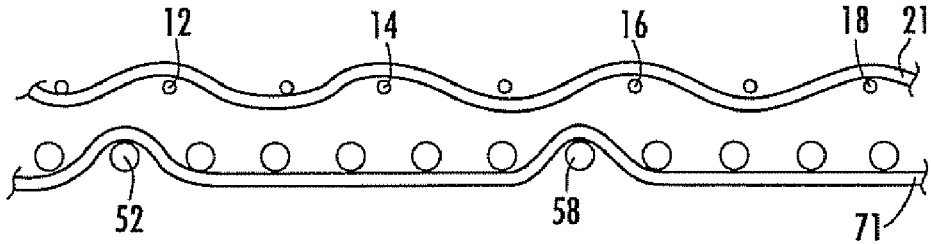

As seen in FIG. 1, the top layer of the fabric 10 includes the top MD yarns 11-18 and the top CMD yarns 21-26 and portions of the stitching yarns 31-42. The top MD yarns and top CMD yarns are interwoven such that each top CMD yarn passes over and beneath top MD yarns in an alternating fashion, with each top CMD yarn passing under the odd-numbered top MD yarns 11, 13, 15 and 17 and over the even-numbered top MD yarns 12, 14, 16 and 18. For example, referring to FIG. 3C, top CMD yarn 21 passes under top MD yarn 11, over top MD yarn 12, under top MD yarn 13, over top MD yarn 14 and so on until it passes over top MD yarn 18. This same pattern is followed by the remaining top CMD yarns 22-26 as they interweave with the top MD yarns.

The top layer (which includes the top MD yarns 11-18 and the top CMD yarns 21-26) and the bottom layer (which includes the bottom MD yarns 51-62 and the bottom CMD yarns 71-76) are stitched together with the stitching yarns 31-42, which are arranged in pairs (see FIG. 1). The stitching yarn pairs are positioned between adjacent CMD yarns. For example, the pair of stitching yarns 33, 34 is positioned between top CMD yarns 21 and 22, and the pair of stitching yarns 35, 36 is positioned between top CMD yarns 22 and 23.

As can be seen in FIGS. 1, 2, 3A and 3B, corresponding pairs of stitching yarns interweave with the top MD yarns and bottom MD yarns in the following pattern. Each of the stitching yarns of the repeat unit can be subdivided into two portions: a fiber support portion which interweaves with the top MD yarns, and a binding portion which passes below the top MD yarns and, in the illustrated embodiment, interweaves with a bottom MD yarn. These are separated at "transitional" top MD yarns, below which one stitching yarn of a pair crosses the other stitching yarn of the pair. The stitching yarns of each pair are interwoven relative to one another such that the fiber support portion of one yarn of the pair is positioned above the binding portion of the other yarn of the pair. The fiber support portion of the odd-numbered stitching yarn of each pair (e.g., 31, 33) interweaves in an alternating fashion with three top MD yarns (alternately passing over two odd-numbered top MD yarns and under one even-numbered top MD yarn), and the fiber support portion of the even-numbered stitching yarn of the pair (e.g., 32, 34) passes over the other two odd-numbered top MD yarns of the repeat unit while passing below the odd-numbered top MD yarn positioned between those two MD yarns. Both of the stitching yarns pass below the transitional top MD yarns.

In its fiber support portion, each stitching yarn 31-42 passes over top MD yarns that the top CMD yarns pass beneath (i.e., they pass over the odd-numbered top MD yarns 11, 13, 15, 17), and passes below top MD yarns that each top CMD yarn passes over (i.e., they pass under the even-numbered top MD yarns 12, 14, 16, 18). For example, the fiber support portion of stitching yarn 31 passes over top MD yarns 17 and 11 while passing under top MD yarn 18, and stitching yarn 32 passes over top MD yarns 13 and 15 while passing below top MD yarn. Both stitching yarns 31, 32 pass below the transitional MD pass below the transitional top MD yarns 12, 16. The remaining stitching yarn pairs weave in a similar manner, although they may be offset from adjacent stitching yarn pairs by one or more top MD yarns. In this manner, the stitching yarns 31-42 and the top CMD yarns 21-26 form a plain weave pattern with the top MD yarns 11-18 (see FIG. 1).

Referring now to FIG. 2, the bottom layer of the fabric 10 includes the bottom MD yarns 51-62, the bottom CMD yarns 71-76, and the binding portions of the stitching yarns 31-42. The bottom CMD yarns 71-76 are interwoven with the bottom MD yarns 51-62 in an "over 1/under 5" sequence. For example, referring to FIG. 3C, bottom CMD yarn 71 passes above bottom MD yarn 52, below bottom MD yarns 53-57, above bottom MD yarn 58, and below bottom MD yarns 59-62 and 51. The other bottom CMD yarns follow a similar "over 1/under 5" weave pattern relative to the bottom CMD yarns, but each is offset from its nearest bottom CMD yarn neighbors such that a six harness broken satin pattern is formed.

Referring again to FIG. 2, as noted above, the bottom layer of the fabric 10 also includes the binding portions of the stitching yarns 31-42. In its binding portion, each stitching yarn 31-42 passes below one bottom MD yarn in the repeat unit such that an "over 5/under 1" pattern is established by the pair of stitching yarns on the bottom surface of the fabric 10 (see FIGS. 2, 3A and 3B). For example, stitching yarn 31 passes below bottom MD yarn 56, and stitching yarn 32 passes below bottom MD yarn 62; each of these stitching yarns pass above all of the other bottom MD yarns (see FIGS. 3A and 3B). Thus, together stitching yarns 31 and 32 follow the aforementioned "over 5/under 1" sequence relative to the bottom MD yarns 51-62. The remaining stitching yarn pairs also follow the same "over 5/under 1" sequence, but may be offset from adjacent stitching yarn pairs by one or more bottom MD yarns.

It can be seen that, in the illustrated repeat unit of the fabric 10, there are twelve bottom MD yarns and eight top MD yarns, i.e., that the ratio of top MD yarns to bottom MD yarns is 2:3. Generally speaking, and as discussed in the aforementioned U.S. Patent Publication No. 2005/0268981 to Barratte (the disclosure of which is hereby incorporated by reference herein in its entirety), the inclusion of more bottom MD yarns than top MD yarns can increase top surface open area and fiber support by top CMD yarns. More specifically to the fabrics embodied herein, it has been determined that a 2:3 top MD yarn/bottom MD yarn ratio can provide significant performance advantages to a forming fabric. For example, the length of CMD knuckles on the top layer can be increased compared to typical plain weave fabrics, which can provide a higher drainage capacity relative to fabrics with a ratio of 1:1, and fabrics with a 2:3 ratio can have better stability than fabrics with a 1:2 ratio, particularly with lower mesh counts also employed in the fabric. In addition, fewer top MD yarns can enable a larger yarn to be employed in certain embodiments of the fabric; a larger yarn can provide improved shower resistance and top surface wear resistance.

Those skilled in this art will appreciate that fabrics of the present invention may take different forms. For example, different numbers of top and bottom machine direction yarns per repeat unit may be employed to satisfy the desirable 2:3 top MD yarn/bottom MD yarn ratio (e.g., four top MD yarns and six bottom yarns, or 16 top MD yarns and 24 bottom MD yarns). As another example, different numbers of stitching yarn pairs per top CMD yarn may be used (e.g., there may be one stitching yarn pair for every two or three top CMD yarns, or alternatively two or three stitching yarn pairs for every top CMD yarn). As a further example, the number of top and/or bottom CMD yarns may vary. Also, the stitching yarns of a pair may interweave with different numbers of top CMD yarns, or one stitching yarn of the pair may only interweave with the top CMD yarns (see, e.g., International Patent Publication No. WO 2004/085741, the disclosure of which is hereby incorporated herein in its entirety). Moreover, the top surface of the fabric need not be a plain weave as illustrated, but may be satin, twill or the like, and the bottom surface of the fabric need not be a broken satin weave, but may take another form, such as a plain weave or twill. Other variations of weave patterns may also be employed with fabrics of the present invention.

The form of the yarns utilized in fabrics of the present invention can vary, depending upon the desired properties of the final papermaker's fabric. For example, the yarns may be monofilament yarns, flattened monofilament yarns as described above, multifilament yarns, twisted multifilament or monofilament yarns, spun yarns, or any combination thereof. Also, the materials comprising yarns employed in the fabric of the present invention may be those commonly used in papermaker's fabric. For example, the yarns may be formed of polyester, polyamide (nylon), polypropylene, aramid, or the like. The skilled artisan should select a yarn material according to the particular application of the final fabric. In particular, round monofilament yarns formed of polyester or polyamide may be suitable.

Although exemplary yarn sizes are set forth above for the fabric of FIGS. 1-3C, those skilled in this art will appreciate that yarns of different sizes may be employed in fabric embodiments of the present invention. For example, the top MD yarns, top CMD yarns, and stitching yarns may have a diameter of between about 0.10 and 0.20 mm, the bottom MD yarns may have a diameter of between about 0.15 and 0.25 mm, and the bottom CMD yarns may have a diameter of between about 0.20 and 0.30 mm. The mesh of fabrics according to embodiments of the present invention may also vary. For example, the mesh of the top surface may vary between about 20×30 to 30×50 (epcm to ppcm), and the total mesh may vary between about 60×45 to 90×75.

A typical fabric with a six harness bottom layer according to embodiments of the present invention may have the characteristics set forth in Table 1.

TABLE 1

| Yarn Type | Size (mm) |
|---|---|
| Top MD | 0.14 |
| Bottom MD | 0.19 |
| Stitching Yarns | 0.13 |
| Top CMD | 0.13 |
| Bottom CMD | 0.27 |
| Mesh (top, epcm* × ppcm**) | 25 × 40 |
| (total) | 75 × 60 |

*ends per centimeter
**picks per centimeter

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paper stock is well understood by those of skill in the art, additional details regarding this aspect of the present invention need not be provided herein.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A triple layer papermaker's fabric, comprising:

a set of top machine direction (MD) yarns;

a set of top cross machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns;

wherein the top MD yarns and the top CMD yarns are interwoven in a series of repeat units and the bottom MD yarns and the bottom CMD yarns are interwoven in a series of corresponding repeat units; and wherein the set of top MD yarns comprises a first number of top MD yarns in each repeat unit, and the set of bottom MD yarns comprises a second number of bottom MD yarns in each repeat unit, and wherein the ratio between the first number and the second number is 2:3.

2. The triple layer papermaker's fabric defined in claim 1, wherein a stitching yarn pair is positioned between each adjacent pair of top CMD yarns.

3. The triple layer papermaker's fabric defined in claim 1, wherein the set of top CMD yarns comprises a third number of top CIvID yarns in each repeat unit, and wherein the set of bottom CMD yarns comprises a fourth number of bottom CMD yarns in each repeat unit, and wherein the third and fourth numbers are the same.

4. The triple layer papermaker's fabric defined in claim 1, wherein each stitching yarn of each pair interweaves with the bottom MD yarns.

5. The triple layer fabric defined in claim 4, wherein each of the stitching yarns passes below one bottom MD yarn.

6. The triple layer papermaker's fabric defined in claim 1, wherein together the top MD yarns, the top CMD yarns, and the stitching yarns form a plain weave pattern on a top surface of the fabric.

7. The triple layer papermaker's fabric defined in claim 1, wherein the mesh ratio of a top surface of the fabric is between about 20×30 and 30×50 epcm to ppcm.

8. The triple layer papermaker's fabric defined in claim 1, wherein each of the stitching yarns of a pair forms the same number of top side CMD knuckles as the other stitching yarn of that pair.

9. The triple layer papermaker's fabric defined in claim 1, wherein the first number is eight, and the second number is twelve.

10. A triple layer papermaker's fabric, comprising:

a set of top machine direction (MD) yarns;

a set of top cross machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of stitching yarn pairs that interweave with the top MD yarns, wherein each of the stitching yarns interweaves with the bottom MD yarns;

wherein the top MD yarns and the top CMD yarns are interwoven in a series of repeat units and the bottom MD yarns and the bottom CMD yarns are interwoven in a series of corresponding repeat units;

wherein a stitching yarn pair is positioned between each adjacent pair of top CMD yarns; and wherein the set of top MD yarns comprises a first number of top MD yarns in each repeat unit, and the set of bottom MD yarns comprises a second number of bottom MD yarns in each repeat unit, and wherein the ratio between the first number and the second number is 2:3.

11. The triple layer papermaker's fabric defined in claim 10, wherein the set of top CMD yarns comprises a third number of top CMD yarns in each repeat unit, and wherein the set of bottom CMD yarns comprises a fourth number of bottom CMD yarns in each repeat unit, and wherein the third and fourth numbers are the same.

12. The triple layer fabric defined in claim 10, wherein each of the stitching yarns passes below one bottom MD yarn.

13. The triple layer papermaker's fabric defined in claim 10, wherein together the top MD yarns, the top CMD yarns, and the stitching yarns form a plain weave pattern on a top surface of the fabric.

14. The triple layer papermaker's fabric defined in claim 10, wherein the mesh ratio of a top surface of the fabric is between about 20×30 and 30×50 epcm to ppcm.

15. The triple layer papermaker's fabric defined in claim 10, wherein each of the bottom MD yarns passes below only one of the bottom CMD yarns.

16. The triple layer papermaker's fabric defined in claim 10, wherein each of the stitching yarns of a pair forms the same number of top side CMD knuckles as the other stitching yarn of that pair.

17. The triple layer papermaker's fabric defined in claim 10, wherein the first number is eight, and the second number is twelve.

18. A method of making paper, comprising the steps of:

(a) providing a papermaker's fabric, the papermaker's fabric comprising:

a set of top machine direction (MD) yarns;

a set of top cross machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns;

wherein the top MD yarns and the top CMD yarns are interwoven in a series of repeat units and the bottom MD yarns and the bottom CMD yarns are interwoven in a series of corresponding repeat units; and wherein the set of top MD yarns comprises a first number of top MD yarns in each repeat unit, and the set of bottom MD yarns comprises a second number of bottom MD yarns in each repeat unit, and wherein the ratio between the first number and the second number is 2:3;

(b) applying paper stock to the papermaker's fabric; and (c) removing moisture from the paper stock.

19. A triple layer papermaker's fabric, comprising:

a set of top machine direction (MD) yarns;

a set of top cross machine direction (CMD) yarns interwoven with the top MD yarns to form a top fabric layer;

a set of bottom MD yarns;

a set of bottom CMD yarns interwoven with the bottom MD yarns to form a bottom fabric layer; and a set of stitching yarn pairs that interweave with the top MD yarns, wherein at least one of the yarns of each stitching yarn pair interweaves with the bottom MD yarns;

wherein the top MD yarns and the top CMD yarns are interwoven in a series of repeat units and the bottom MD yarns and the bottom CMD yarns are interwoven in a series of corresponding repeat units; and wherein the set of top MD yarns comprises a first number of top MD yarns in each repeat unit, and the set of bottom MD yarns comprises a second number of bottom MD yarns in each repeat unit, and wherein the ratio between the first number and the second number is 2:3; and wherein each of the bottom MD yarns passes below only one of the bottom CMD yarns.

* * * * *

UNITED STATES PATENT AND TRADEMARK OFFICE

CERTIFICATE OF CORRECTION

PATENT NO. : 7,581,567 B2
APPLICATION NO. : 11/380675
DATED : September 1, 2009
INVENTOR(S) : Ward et al.

It is certified that error appears in the above-identified patent and that said Letters Patent is hereby corrected as shown below:

In the Claims:

Column 8, Claim 3, Line 9: Please correct "of top CIvID yarns"
to read -- of top CMD yarns --.

Signed and Sealed this

First Day of December, 2009

David J. Kappos

David J. Kappos
*Director of the United States Patent and Trademark Office*